US007470113B2

(12) United States Patent
Tran et al.

(10) Patent No.: US 7,470,113 B2
(45) Date of Patent: Dec. 30, 2008

(54) SPLIT KNIFE EDGE SEALS

(75) Inventors: Tuy Tran, West Hartford, CT (US); John T. Pickens, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 378 days.

(21) Appl. No.: 11/472,577

(22) Filed: Jun. 22, 2006

(65) Prior Publication Data

US 2007/0297897 A1 Dec. 27, 2007

(51) Int. Cl.
*F01D 11/00* (2006.01)

(52) U.S. Cl. ..... 416/198 A; 415/174.4; 415/174.5; 415/230; 277/412; 277/413; 277/416; 277/421; 29/888.02; 29/888.021; 29/889.2

(58) Field of Classification Search ..... 415/173.4, 415/173.5, 173.7, 174.4, 174.5, 199.5, 230, 415/231; 416/198 R, 198 A, 200 R, 200 A, 416/201 R, 201 A; 277/411, 412, 413, 416, 277/421; 29/888.02, 888.021, 889.2
See application file for complete search history.

(56) References Cited

U.S. PATENT DOCUMENTS 1,792,288 A * 2/1931 Dempster ..... 277/416
3,067,490 A * 12/1962 Luthy et al. ..... 29/889.2
3,295,825 A * 1/1967 Hall, Jr. ..... 415/173.7
3,656,864 A * 4/1972 Wagle ..... 415/174.4
3,701,536 A * 10/1972 Matthews et al. ..... 277/415
3,846,899 A * 11/1974 Gross ..... 415/173.7
4,088,422 A * 5/1978 Martin ..... 416/198 A

* cited by examiner

*Primary Examiner*—Christopher Verdier
(74) *Attorney, Agent, or Firm*—Carlson, Gaskey & Olds

(57) ABSTRACT

A compressor for a turbine engine includes multiple compressor disks having rotor blades mounted about the circumference of each of the disks. A plurality of stator vanes extend between the rotor blades of axially adjacent disks. A knife edge seal segment is supported by each disk backbone extending from the disks and contacts the stator vanes to restrict leakage of compressed air from between the stator vane and the compressor rotor to limit the recirculation of air. Retaining flanges extend from each disk rim to retain the knife edge seal segments to the disk backbone and spacer bridges integral to the knife edge seal segments prevent axial movement of the knife edge seal segments. A plurality of lock assemblies are spaced about the circumference of the disk backbone to prevent circumferential shifting and rotating of the knife edge seal segments during operation.

15 Claims, 5 Drawing Sheets

SPLIT KNIFE EDGE SEALS

BACKGROUND OF THE INVENTION

The invention generally relates to an arrangement for loading and retaining knife edge seals within a compressor.

Turbine engines include high and low pressure compressors to provide compressed air for combustion within the engine. Each compressor typically includes multiple rotor disks. Stator vanes extend between each rotor disk along a compressor axis. Knife edge seals are formed integrally into each rotor disk to contact the stator vanes. The seals restrict leakage of compressed air from between the stator vanes and the rotor disks to limit the recirculation of air within the compressor.

During operation of the compressor the rotor disk is repeatedly heated and cooled, resulting in compressive and tensile hoop stresses on the outer portion of the disk, including the knife edge seals. This cyclic loading from the thermal cycles fatigue the disk and knife edge seals. Any areas of concentrated stress are prone to cracking as a result of the fatigue. The hoop stress in the knife edge seals can practically be eliminated by making the knife edge seals non-integral to the disk, and segmented. This will increase the durability of the rotor.

An improved arrangement for loading and retaining knife edge seals within a compressor is needed.

SUMMARY OF THE INVENTION

An example compressor for a turbine engine according to this invention includes an arrangement for incorporating knife edge seals which are separate from the compressor disk.

A typical compressor includes multiple rotor disks having rotor blades mounted about the circumference of each of the disks. A plurality of stator vanes extend axially between adjacent disks. A knife edge seal assembly is supported by the backbone of the disk assembly. The assembly is formed from a plurality of knife edge seals segments arranged about the circumference of the disk backbone. The knife edge seal segments are proximate the stator vanes to restrict the leakage of compressed air from between the stator vanes and the compressor rotor to limit the recirculation of air within the compressor. Retaining flanges also extend from a rim on each disk to retain the knife edge seals segments on the disk backbone.

To begin assembly a knife edge seal segment is inserted past a retaining flange on each disk. The seal includes an integral spacer bridge. The adjacent knife edge seal segments with an integral spacer bridge are assembled with each spacer bridge staggered from the previous spacer bridge. A lock assembly is inserted between the retaining flanges after each adjacent knife edge seal segment.

The process of inserting the knife edge seal segments and lock assemblies is repeated until all the knife edge seal segments and lock assemblies have been assembled onto the disks. The knife edge seal segments and lock assemblies on one of the disks are moved around the circumference of the disk to locate spacer bridges on adjacent disks across from one another, i.e. they are no longer staggered.

Once assembled and rotated into position the knife edge seal segments and lock assemblies must be prevented from shifting and rotating circumferentially during operation of the compressor. A set screw on each lock assembly is tightened, moving the lock assembly into a lock position. The lock assemblies each include a rounded end of the set screw. The disk backbones include a mating depression, which interacts with the rounded set screw to prevent rotation of the lock assembly during compressor operation.

Each of the plurality of knife edge seal segments defines at least one segment hole. The plurality of lock assemblies spaced about the circumference of the disk backbone retain at least one of the plurality of knife edge seal segments to prevent circumferential movement of the plurality of knife edge seal segments. A first plurality of spacer bridged are each in contact with at least one of a second plurality of spacer bridges. At least one of the plurality knife edge seal segments is in contact with one of the plurality of retaining flanges when the set screw is in the extended position. The plurality of lock assemblies each retain at least one of the first plurality of knife edge seal segments to prevent circumferential movement of the first plurality of knife edge seal segments about the compressor disks.

These and other features of the present invention can be best understood from the following specification and drawings, the following of which is a brief description.

DETAILED DESCRIPTION OF THE PREFERRED EMBODIMENT

Figure 1:
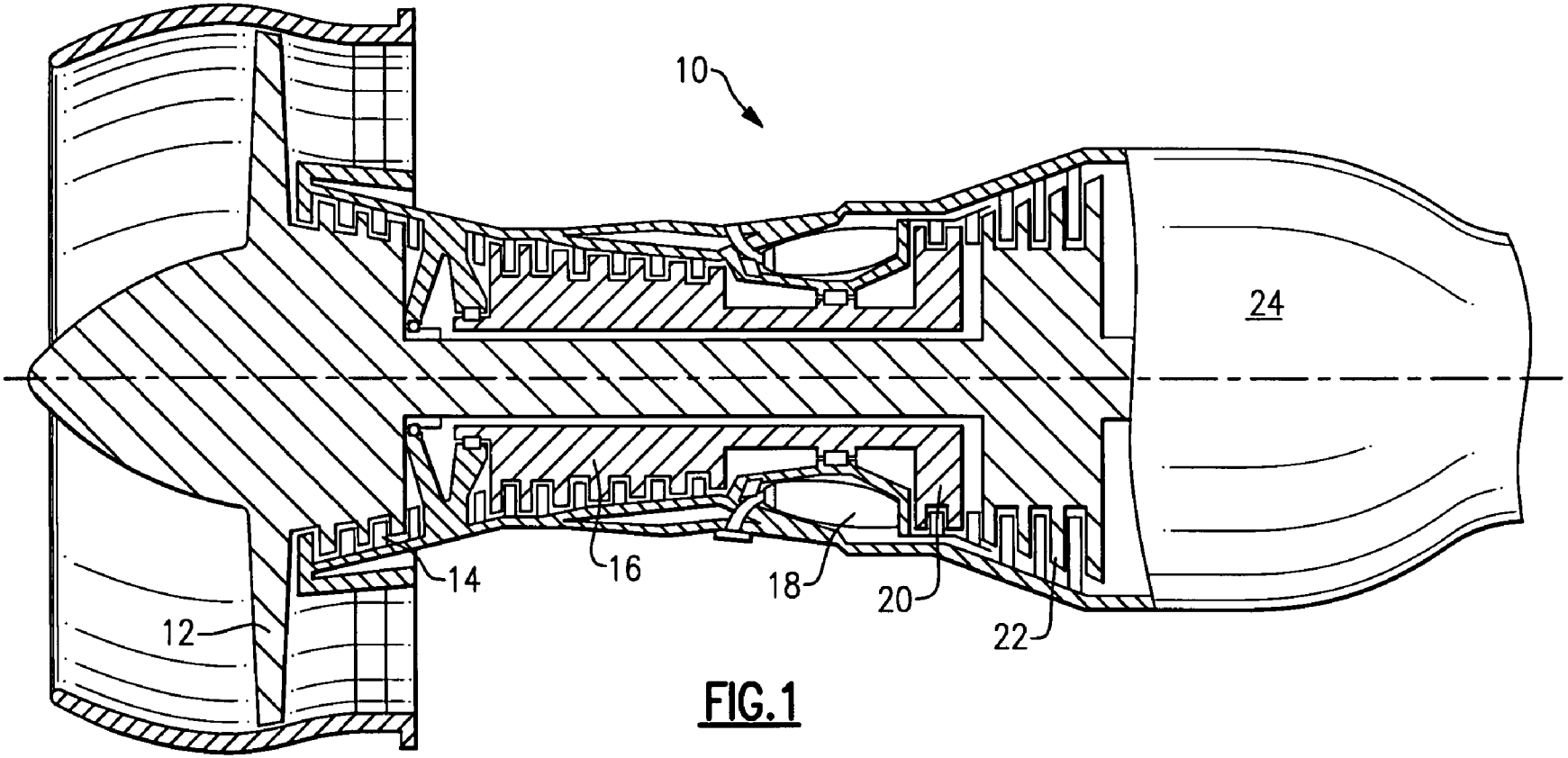
FIG. 1 is a schematic view of an example turbine engine of the present invention.

FIG. 1 is a schematic view of a turbine engine 10. Air is pulled into the turbine engine 10 by a fan 12 and flows through a low pressure compressor 14 and a high pressure compressor 16. Fuel is mixed with the air and combustion occurs within the combustor 18. Exhaust from combustion flows through a high pressure turbine 20 and a low pressure turbine 22 prior to leaving the engine through the exhaust nozzle 24.

Figure 2:
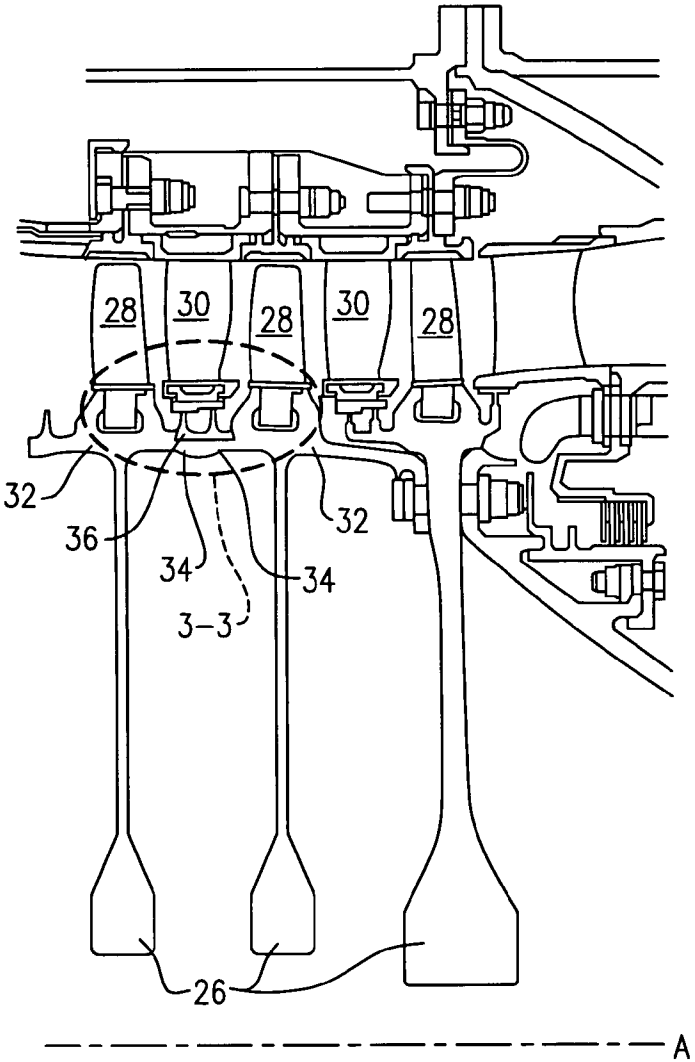
FIG. 2 illustrates a portion of a cross-section of a typical compressor for the example turbine engine of the present invention.

FIG. 2 illustrates a portion of a cross-section of a typical compressor including multiple disks 26 defining a compressor rotor. Each disk 26 rotates about an axis A located along the centerline of the turbine engine 10. A plurality of rotor blades 28 are mounted about the circumference of each of the disks 26. A plurality of stator vanes 30 extend between the rotor blades 28 of axially adjacent disks 26, as shown.

Each disk 26 includes a disk rim 32. The disk rim 32 supports the rotor blades 28. A backbone 34 extends from each disk rim 32. A plurality of knife edge seal segments 36 are supported by the backbone 34. The knife edge seal segments 36 are preferably formed of the same material as the disk 26 such as any ferrous, nickel, or ceramic materials. For example, a lightweight material such as Titanium. The knife edge seal segments 36 are each in close proximity to the stator vanes 30, as shown, to restrict leakage of the compressed air from between the stator vane and the compressor rotor to limit the recirculation of air within the compressor. In fact the knife edge seal segments 36 contact an abradable honeycomb material 31 associated with the stator vanes 30. Retaining flanges 38*a* and 38*b* (FIG. 3) extend from each disk rim 32 to retain the knife edge seal segments 36 to the backbones 34.

Figure 3:
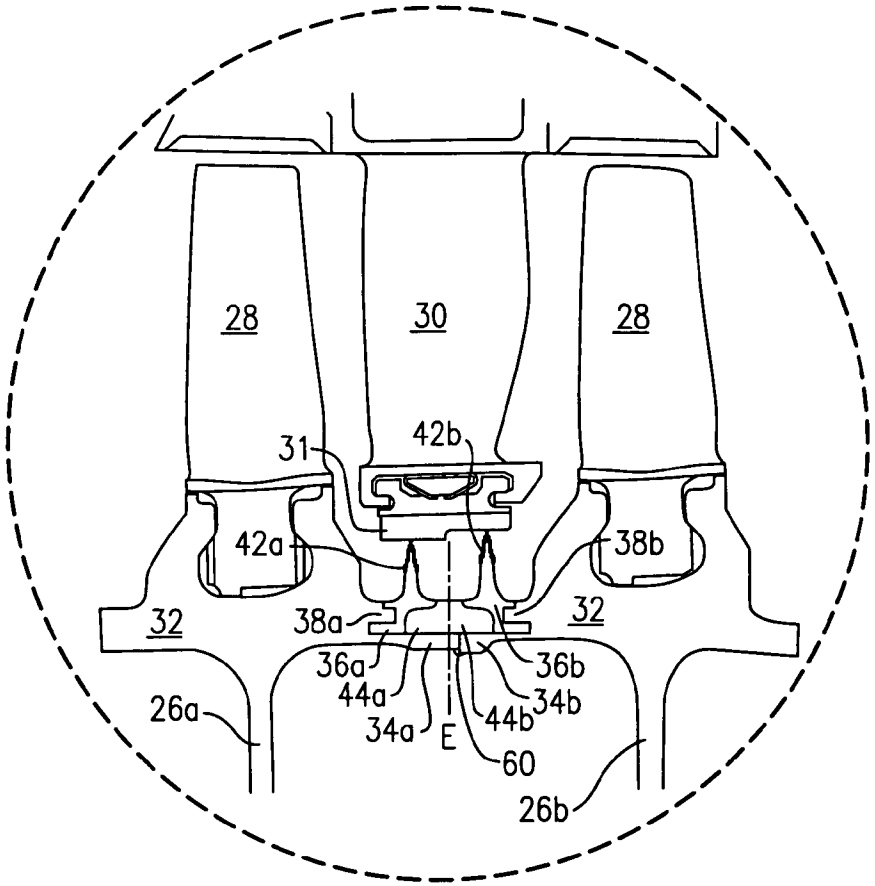
FIG. 3 is an enlarged view of region 3-3 from FIG. 2, illustrating a portion of example disks which are axially adjacent to one another.

FIG. 3 illustrates portions of example disks 26*a* and 26*b* which are axially adjacent to one another. A backbone 34*a* on the disk 26*a* is in contact with a backbone 34*b* of the axially adjacent disk 26*b*. The backbone 34*a* is preferably welded to the backbone 34*b*, illustrated by weld bead 60. However, the backbone 34*a* and the backbone 34*b* can also be bolted together or secured in another known manner. A retaining flange 38*a* extends from the disk 26*a* and a retaining flange 38*b* extends from the disk 26*b*. A plurality of knife edge seal segments 36*a* are arranged about the circumference of the backbone 34*a* and a plurality of knife edge seal segments 36*b* are arranged about the circumference of the backbone 34*b*. Each knife edge seal segment 36*a* and 36*b* is supported by the corresponding backbones 34*a* and 34*b* and retained by the corresponding retaining flange 38*a* and 38*b*. The backbone 34*a* and 34*b* may be of unequal lengths and one of the backbones 34*a* may also support a portion of the knife edge seal segment 36*b* of the axially adjacent disk 26*b*.

Referring to FIGS. 4 through 8 assembly of the knife edge seal segments 36 onto the disks 26 is explained. The knife edge seal segment 36*a* is inserted past the retaining flange 38*a* such that a body portion 40*a* of the knife edge seal segment 36*a* contacts the backbone 34*a*. The knife edge seal segment 36*b* is then inserted past the retaining flange 38*b* in a similar manner. A knife edge runner 42*a* protrudes radially outward from the body portion 40*a* and proximate the stator vane 30. Likewise, a body portion 40*b* of the knife edge seal segment 36*b* contacts the backbone 34*b* and a knife edge runner 42*b* protrudes from the body portion 40*b*, proximate the stator vane 30. The knife edge runners 42*a* and 42*b* contact different portions of the same stator vane 30. Preferably, there are multiple knife edge runners 42 contacting each stator vane 30. Each knife edge seal segment 36 may have multiple knife edge runners 42 protruding form the body portion 40.

Once assembled, each knife edge seal segment 36 mates with a circumferentially adjacent knife edge seal segment 36 to provide a rigid structure. Stress placed on disk 26 during compressor operation does not transfer to the knife edge seal segment 36 because the knife edge seal segments 36 are separate elements from the disks 26 and segmented. The arrangement also allows for replacement of individual knife edge seals segments 36 without requiring an entire new disk 26.

Figure 4:
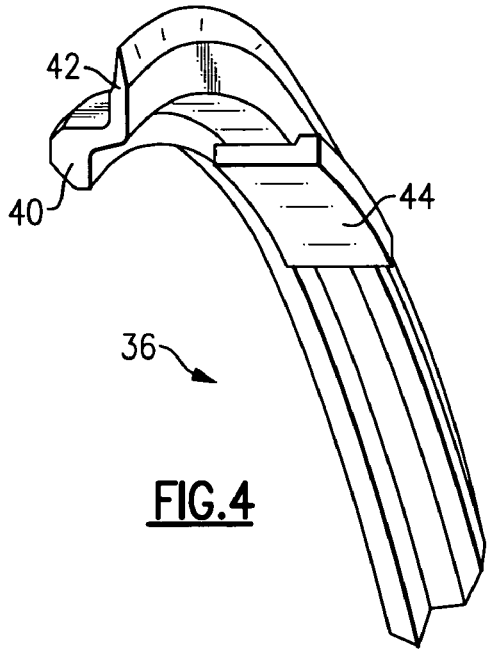
FIG. 4 is a perspective view of a portion of an example knife edge seal segment with an integral spacer bridge and the lock assemblies of the present invention during assembly.
Figure 5:
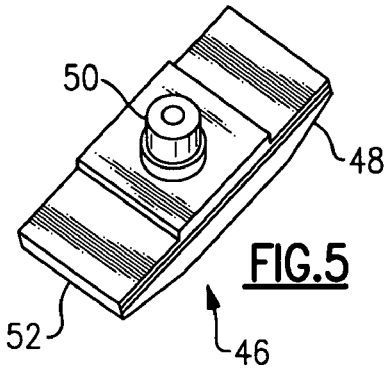
FIG. 5 is a perspective view of the lock assembly of the present invention.
Figure 6:
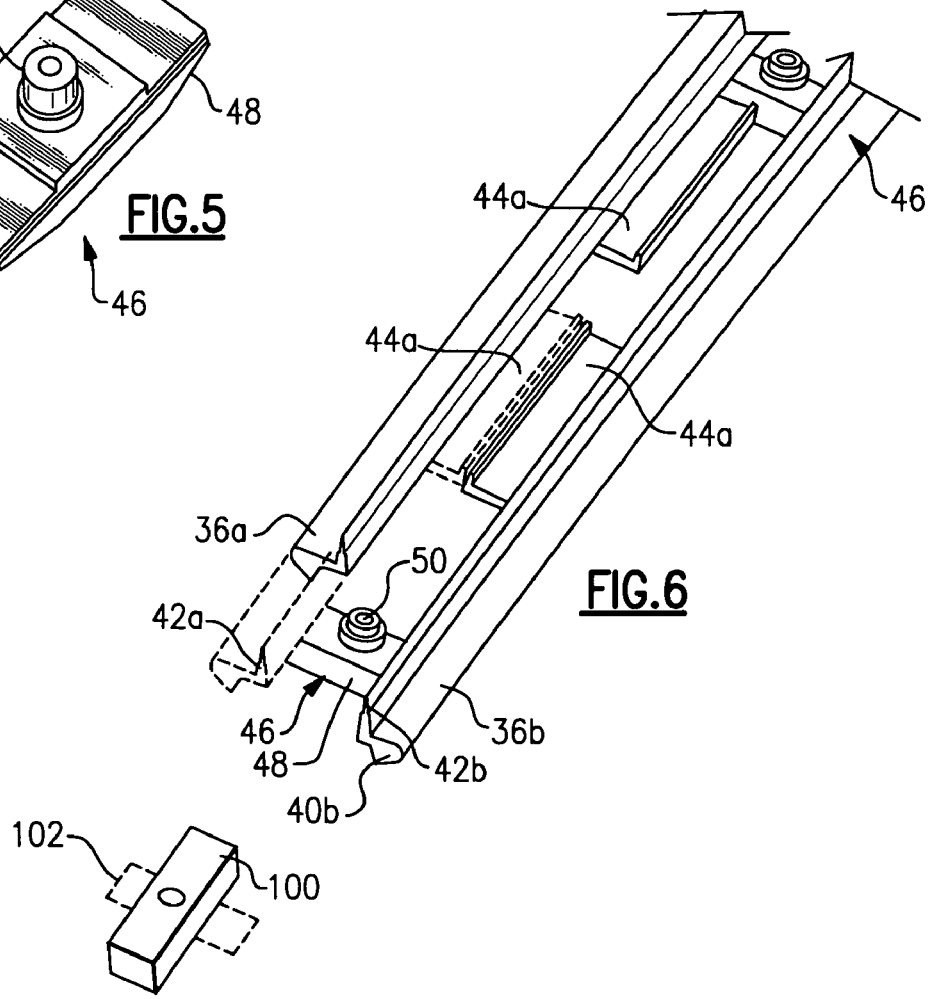
FIG. 6 is a perspective view of a portion of the example knife edge seal segment with the spacer bridge and lock assemblies of the present invention inserted on the compressor disks.

Each of the knife edge seal segments 36*a* and 36*b* have an integral spacer bridge 44*a* extending from the body portion 40*a* and 40*b*, as illustrated in FIG. 4. In order to assemble the knife edge seal segments 36*a* and 36*b* the spacer bridges 44*a* and 44*b* are staggered from one another as they are assembled, as shown in FIG. 6. The staggered arrangement of the integral spacer bridges 44*a* and 44*b* allows the knife edge seal segment 36*b* to be inserted past the retaining flange 38*b* when the knife edge seal segment 36*a* is already assembled. A lock assembly 46, shown in FIG. 5, is inserted between the knife edge seal segments 36*a* and 36*b* after each staggered spacer bridges 44*a* and 44*b*.

The lock assemblies 46 each include a lock housing 48 and a set screw 50. The lock assembly 46 is assembled by inserting the lock housing 48 past the retaining flanges 38*a* and 38*b* such that the bottom of the lock housing 48 is in contact with the disk backbones 34*a* and 34*b*. The lock assembly 46 is then rotated 90-degrees about a lock axis. That is, the lock assemblies 46 are initially inserted in an orientation as shown at 100 in FIG. 6, then rotated to the orientations 102, or that shown between knife edge seal segments 36*a* and 36*b* in FIG. 6.

When rotating the lock assembly 46 a portion of the lock housing 48 is placed under the knife edge seal segments 36*a* and 36*b* to prevent the lock housing 48 from upward movement. Once rotated the lock housing 48 interferes with the knife edge seal segments 36*a* and 36*b* and is prevented from movement past the retaining flanges 38*a* and 38*b*. The lock housing 48 has pressure faces 52 to provide a surface for contacting the knife edge seal segments 36*a* and 36*b*. During assembly of the knife edge seal segments 36 the lock assemblies 46 remain in a retracted position.

Figures 7, 8:
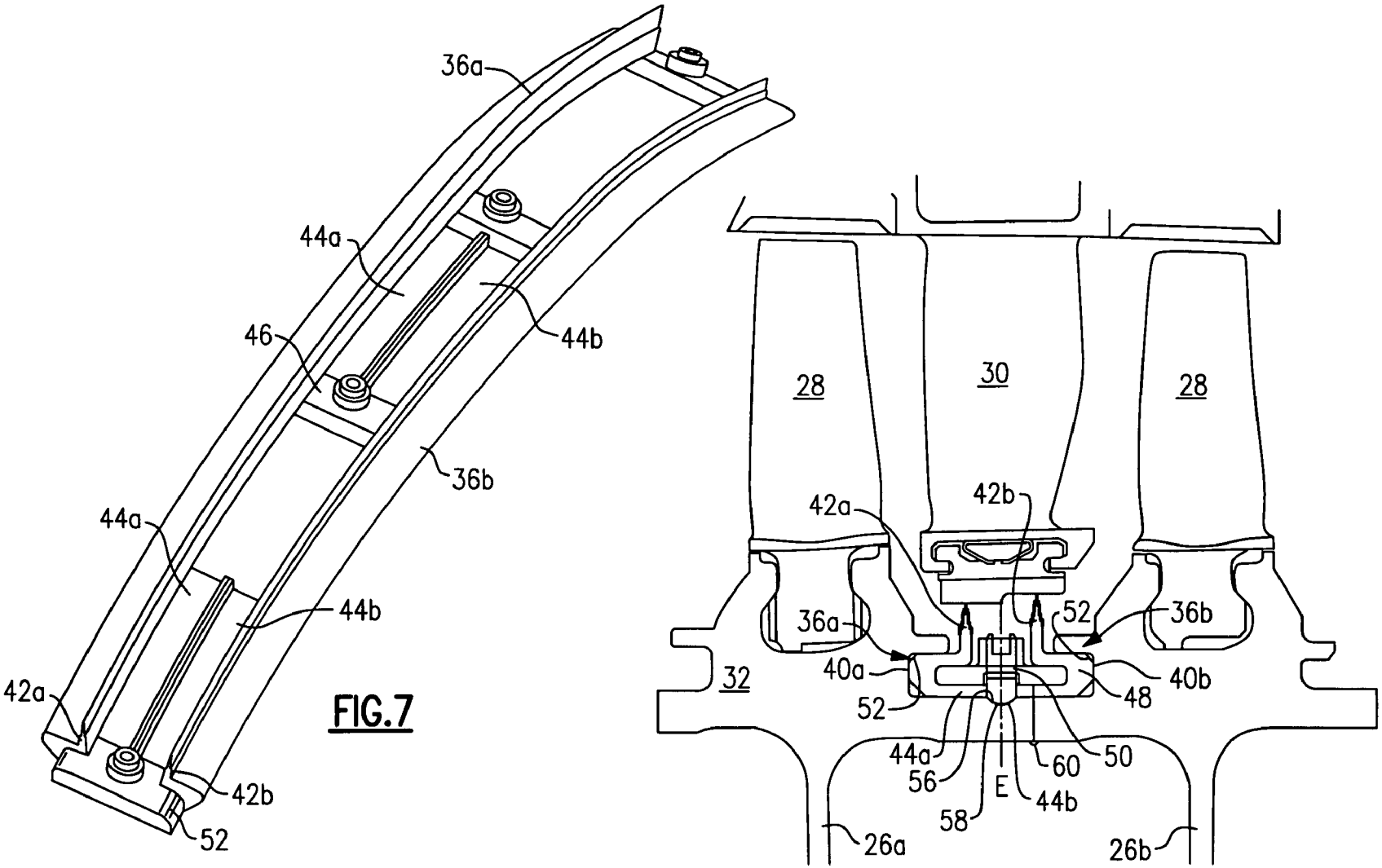
FIG. 7 is a perspective view of a portion of the example knife edge seal segment with the spacer bridge and lock assemblies of the present invention once assembled.
FIG. 8 is a cross-section of axially adjacent example disks where the lock assembly of FIG. 5 is in a lock position.

The process of inserting the knife edge seals segments 36 with the spacer bridges 44 and the lock assemblies 46 is repeated until all the knife edge seal segments 36 and lock assemblies 46 have been assembled onto the disks 26. The knife edge seal segments 36*a* and 36*b* with the spacer bridges 44*a* and 44*b* are in a staggered arrangement as described above in order to provide space for assembly. When all the knife edge seals segments 36 have been inserted the axial movement along the axis A of the turbine engine 10 is no longer necessary. Therefore, once inserted, the knife edge seal segments 36*a* with spacer bridges 44*a* are moved about the circumference of the disk 26*a*, shown in phantom in FIG. 6. The adjacent knife edge seal segments 36*b* with spacer bridges 44*b* remain stationary. FIG. 7 illustrates another example of the lock assemblies 46 and knife edge seal segments 36*a* and 36*b* with the spacer bridges 44*a* and 44*b* once rotated. The spacer bridges 44*a* are moved to locate the spacer bridge 44*a* and spacer bridges 44*b* across from one another, i.e. they are no longer staggered. The spacer bridges 44*a* and 44*b* contact each other and prevent axial movement of the knife edge seal segments 36*a* and 36*b* along the axis A of the turbine engine 10. A single spacer bridge 44*a* and spacer bridge 44*b* can be located between each of the lock assemblies 46. Alternatively, multiple spacer bridges 44*a* and 44*b* can be located between each of the lock assemblies 46.

In one example, there are eight lock assemblies 46. The number of lock assemblies 46 and the number and length of the knife edge seal segments 36 may vary. One skilled in the art would be able to determine the appropriate numbers and lengths of knife edge seal segments 36 and lock assemblies 46.

Referring now to FIG. 8, once assembled and rotated into position, the knife edge seal segments 36 and lock assemblies 46 must be prevented from shifting and rotating circumferentially. Thus, the lock assemblies 46 are moved from the retracted position to the extended position. The set screw 50 on each lock assembly 46 is tightened, thus moving the lock assembly 46 into the extended or "locked" position. The lock assemblies 46 each include a first interlocking feature 56 and the backbone 34*a* includes a second interlocking feature 58. When the lock assemblies 46 are in the lock position the first interlocking feature 56 and the second interlocking feature 58 interact together to prevent circumferential movement of the lock assemblies 46. In the example shown, the first interlocking feature 56 is a rounded end of set screw 50 and the second interlocking feature 58 is a depression in the backbone 34*a*. The second interlocking feature 58 may be a continuous depression or a plurality of depressions spaced around the circumference of the backbone 34*a* at desired location. Of course, the second interlocking feature 58 may be formed in the second backbone 34*b*, or partially formed in both the first and second backbone 34*a* and 34*b*.

Figure 9:
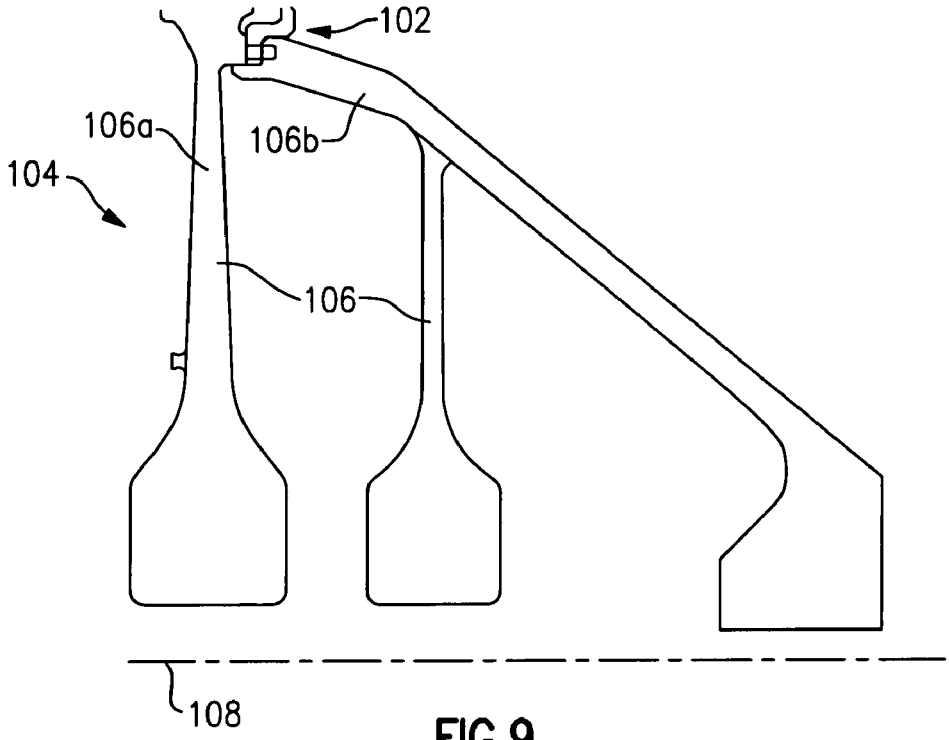
FIG. 9 is a portion of a cross-section for a second example compressor of the present invention.
Figure 10:
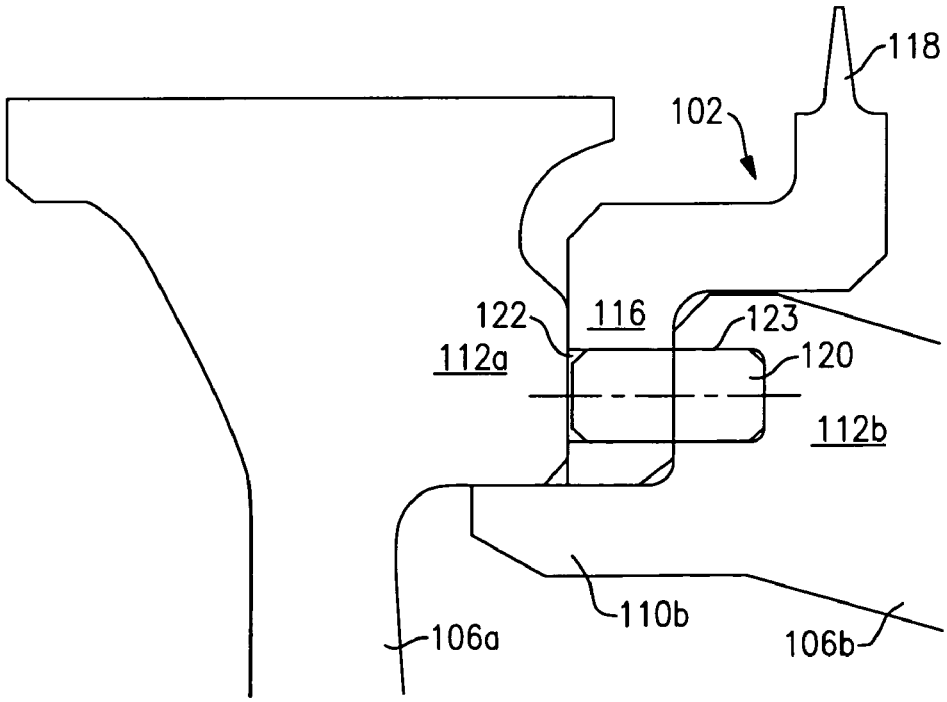
FIG. 10 is an enlarged cross-section of axially adjacent disks of the second example.

FIGS. 9 and 10 are a second example of a turbine engine utilizing knife edge seal segments 102 of the present invention within a compressor 104. FIG. 9 illustrates a portion of a cross-section of a typical compressor 104 including multiple disks 106 defining a compressor rotor. Each disk 26 rotates about an axis located along a centerline 108 of the turbine engine.

In the second example the disks 106*a* and 106*b* are bolted together at the centerline 108 of the engine. The bolts are not shown. Compressor disks 106 are typically bolted together at the rear of the compressor 104. Disk 106*b* is illustrated as a rear shaft of the rotor. However, the second example may be utilized for any consecutive disks 106 within the compressor 104 that are bolted together.

Referring to FIG. 10, the disk 106*b* includes a disk backbone 110*b* extending from a rim 112*b* of the disk 106*b*. A knife edge seal segment 102 is placed on the disk backbone 110*b*. A body portion 116 of the knife edge seal segment 102 is in contact with the disk rim 112*b* and a knife edge 118 extends away from the body portion 116, as illustrated. Each knife edge seal segment 102 may have a plurality of knife edges 118 extending away from the body portion 116.

A pin 120 is inserted through a segment hole 122 in the knife edge seal segment 102 to retain the knife edge seal segment 102 to the disk 106*b*. Each knife edge seal segment 102 may have a plurality of segments holes 122. A pin 120 is inserted into each of the segment holes 122 and into a corresponding rim slot 123. Additional knife edge seal segments 102 and pins 120 are inserted until the circumference of the disk backbone 110*b* has been filled. Once assembled the disk 106*b* is positioned within the compressor 104 and bolted to disk 106*a*. Rim 112*a* of disk 106*a* is in contact with the knife edge seal segments 102 assembled to disk 106*b*. The rim 112*a* may overlap the backbone 110*b* to limit the recirculation of air. Pins 120 prevent the knife edge seal segments 102 from rotating circumferentially about the disk 106*b*.

Alternately the knife edge seal segments 102 may be inserted between the rim 112*a* and the rim 112*b* after the disk 106*b* has been assembled within the compressor 104. In this instance the knife edge seal segments 102 would not require segment holes 122 or pins 120. Instead, a lock assembly 46 (illustrated in FIG. 5) would be inserted between each circumferentially adjacent knife edge seal segments 102. The disk rims 112*a* and 112*b* would be formed to have a retaining flange, as described in the above embodiment, to retain the lock assembly 46, and the backbone 110*b* would include an interlocking feature to correspond with interlocking feature 56 on the lock assembly 46. The body portion 116 may be shaped to fit with the retaining flange 126 and still allow the knife edge seal segments 102 to be inserted between the disk rims 112*a* and 112*b*.

Although the example embodiment discloses an arrangement of assembling knife edge seal segments onto a rotor disk for a compressor the arrangement may be used for any rotor and seal assembly.

Although a preferred embodiment of this invention has been disclosed, a worker of ordinary skill in this art would recognize that certain modifications would come within the scope of this invention. For that reason, the following claims should be studied to determine the true scope and content of this invention.

The invention claimed is:

1. A compressor for a jet engine comprising:

a plurality of disks each defining a disk rim having a disk backbone;

a plurality of knife edge seal segments located about the circumference of each of the backbones, wherein each of the plurality of knife edge seal segments are supported by the backbones and retained to the disk rims; and wherein each disk rim comprises a retaining flange protruding from the disk rim and each of the plurality of knife edge seal segments are supported by and retained by the retaining flanges;

a first backbone protruding in a first direction, a second backbone protruding in a second direction, opposing the first direction, and a portion of the plurality of knife edge seal segments are supported by the first backbone, and the remaining knife edge seal segments are supported by the second backbone;

a plurality of lock assemblies spaced about the circumference of the disk backbones to retain at least one of the plurality of knife edge seal segments to prevent circumferential movement of the plurality of knife edge seal segments about the plurality of disks; and a spacer bridge extending from each of the plurality of knife edge seal segments and located between each of the plurality of lock assemblies, wherein a first plurality of spacer bridges are supported by the first backbone and a second plurality of spacer bridges are supported by the second backbone, and the first plurality of spacer bridges are each in contact with at least one of the second plurality of spacer bridges.

2. The compressor of claim 1, wherein the disk rims define a plurality of rim slots and each of the plurality of knife edge seal segments define at least one segment hole, and wherein pins extend through the segment holes and into the rim slot to retain the knife edge seal segment to the disk rims.

3. The compressor of claim 1, wherein the first backbone and the second backbone are welded together.

4. The compressor of claim 1, wherein the plurality of lock assemblies each comprises a housing and a set screw movable between a retracted position and an extended position, at least one of the plurality knife edge seal segments is in contact with the one of the plurality of retaining flanges when the set screw is in the extended position.

5. The compressor of claim 1, wherein a set screw provides a first interlocking feature and one of the plurality of disk backbones includes a second interlocking feature and the first interlocking feature interacts with the second interlocking feature when the set screw is in the extended position.

6. The compressor of claim 1, wherein the plurality of knife edge seal segments each comprise a knife edge runner that is proximate a portion of a stator vane.

7. A turbine engine seal comprising:

a first plurality of knife edge seal segments to be supported by a compressor disk;

a plurality of lock assemblies to be spaced about the circumference of the compressor disk;

a spacer bridge extending from each knife edge seal segment and located between each of the plurality of lock assemblies; and the plurality of lock assemblies each comprises a housing and a set screw movable between a retracted position and an extended position.

8. The turbine engine seal of claim 7, wherein the plurality of lock assemblies each retain at least one of the first plurality of knife edge seal segments to prevent circumferential movement of the first plurality of knife edge seal segments about the compressor disk when the seal is mounted on a compressor disk.

9. The turbine engine seal of claim 7, wherein the set screw provides a first interlocking feature that will interact with a second interlocking feature on the compressor disk when the set screw is in the extended position.

10. The turbine engine seal of claim 7, wherein the first plurality of knife edge seal segments each comprise a knife edge runner proximate a portion of a stator vane.

11. A method of assembling a compressor comprising:

a) inserting a first plurality of knife edge seal segments having a first plurality of spacer bridges extending therefrom, adjacent to one another on a first disk backbone;

b) inserting a second plurality of knife edge seal segments having a second plurality of spacer bridges extending therefrom adjacent one another on a second disk backbone such that the first plurality of spacer bridges and the second plurality of spacer bridges are staggered from one another;

c) placing a lock assembly on one of the first disk backbones protruding from a first rotor disk and one of the second disk backbones protruding from a second rotor disk between the first and the second plurality of staggered spacer bridges;

d) repeating said steps a) through d) until the first disk backbone and the second disk backbone are filled;

e) sliding the first plurality of knife edge seal segments and lock assemblies on the first disk backbone until the first plurality of spacer bridges are aligned with the second plurality of spacer bridges; and f) locking each of the lock assemblies to prevent circumferential motion of the first plurality of knife edge seal segments and the second plurality of knife edge seal segments.

12. The method of claim 11, wherein step a) comprises placing the first rotor disk and the second rotor disk adjacent one another along a common axis such that the first disk backbone protrudes from the first rotor disk in a first axial direction and the second disk backbone protrudes from the second rotor disk in a second axial direction, opposing the first axial direction, such that the first disk backbone and the second disk backbone are in contact with one another.

13. The method of claim 11, wherein steps a) and b) comprise inserting each of the knife edge seal segments between a first retaining flange extending from the first rotor disk and the first disk backbone and inserting each of the second plurality of knife edge seal segments between a second retaining flange extending from the second rotor disk and the second disk backbone.

14. The method of claim 11, wherein step c) comprises inserting each lock assembly past the first knife edge seal segment and the second knife edge seal segment and rotating the lock assembly such that a respective portion of each lock assembly is located under a respective portion of each of the first plurality of knife edge seal segments and a respective portion of each of the second plurality of knife edge seal segments.

15. The method of claim 11, wherein step f) comprises tightening a set screw in each lock assembly to move a lock assembly housing through a depression in the associated knife edge seal segment to cause one of the first plurality of knife edge seal segments to contact a first retaining flange on the first rotor disk and one of the second plurality of knife edge seal segments to contact a second retaining flange on the second rotor disk.

* * * * *